US007941079B2

(12) United States Patent
Hatano

(10) Patent No.: US 7,941,079 B2
(45) Date of Patent: May 10, 2011

(54) IMAGE FORMING APPARATUS

(75) Inventor: Fukashi Hatano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 12/266,393

(22) Filed: Nov. 6, 2008

(65) Prior Publication Data

US 2009/0123194 A1 May 14, 2009

(30) Foreign Application Priority Data

Nov. 9, 2007 (JP) ..... 2007-292190

(51) Int. Cl.
*G03G 15/08* (2006.01)

(52) U.S. Cl. ..... 399/269

(58) Field of Classification Search ..... 399/269
See application file for complete search history.

(56) References Cited

U.S. PATENT DOCUMENTS 4,478,512 A * 10/1984 Zoltner ..... 399/106

FOREIGN PATENT DOCUMENTS

| | | |
|---|---|---|
| JP | 3-168665 | 7/1991 |
| JP | 2003-15412 | 1/2003 |

* cited by examiner

*Primary Examiner* — Quana M Grainger
(74) *Attorney, Agent, or Firm* — Canon USA Inc IP Division

(57) ABSTRACT

A developing apparatus includes first and second developer bearing members configured to bear developer and a connecting member configured to connect the first and second developer bearing members to each other such that the second developer bearing member is swingable relative to the first developer bearing member. A first adjusting member which adjusts the positions of magnetic poles of a first magnetic member disposed in the first developer bearing member is fixed to the developing apparatus. A second adjusting member which adjusts the positions of magnetic poles of a second magnetic member disposed in the second developer bearing member is fixed to the connecting member.

5 Claims, 12 Drawing Sheets

IMAGE FORMING APPARATUS

BACKGROUND OF THE INVENTION

1. Field of the Invention

The present invention relates to image forming apparatuses, such as a copy machine, a printer, and a facsimile machine, which form an image by electrophotography or the like. In particular, the present invention relates to a developing apparatus which forms a toner image on an image bearing member using toner.

2. Description of the Related Art

In general, image forming apparatuses, such as a copy machine and a laser beam printer, which use electrophotography, form an image as follows. That is, a charging device uniformly charges a surface of an image bearing member (photosensitive drum), and the thus-charged surface is subjected to an exposure process based on an image using a semiconductor laser. As a result, an electrostatic latent image is formed. Then, a developing apparatus forms a toner image from the electrostatic latent image, and the toner image is transferred onto a transferring medium (recording medium). The toner image that is transferred onto the transferring member is fixed with heat and pressure by a fixing apparatus.

To increase the processing speed of the image forming apparatus and to improve the image quality, a developing apparatus structured as shown in FIG. 11 has been proposed (see Japanese Patent Laid-Open No. 3-168665). As shown in FIG. 11, according to Japanese Patent Laid-Open No. 3-168665, the processing speed can be increased because a photosensitive drum 301 is provided with a developing device 304 having developing sleeves 341 and 342.

Japanese Patent Laid-Open No. 2003-15412 describes another example of a developing apparatus including a plurality of developing sleeves. This developing apparatus includes a first developing sleeve and a second developing sleeve capable of swinging about the first developing sleeve. Each of the sleeves has a portion that is brought into contact with a photosensitive drum so that gaps (SD gaps) between the photosensitive drum and the sleeves can be stabilized and a gap between the two sleeves can be maintained constant. As a result, the image quality can be improved.

A magnetic body (magnetic roller) having magnetic poles is disposed in each of the developing sleeves, and it is necessary to place the magnetic poles at predetermined positions. In the case where, for example, the number of developing sleeves is one, the adjustment of the magnetic poles is generally performed as follows. That is, an end portion of the magnetic body is formed in a D-shape, and a fitting member that can be fitted to the D-shaped end portion is provided. The fitting member is rotated so that the magnetic poles can be placed at the desired positions. After the adjustment, the fitting member is fixed to a developer container. Thus, the positions of the magnetic poles can be adjusted.

However, in the case where one of a pair of developing sleeves swings about the other developing sleeve, if the positions of magnetic poles in the swingable developing sleeve are adjusted in a similar manner, the swingable developing sleeve would be fixed to the developer container and becomes incapable of swinging.

SUMMARY OF THE INVENTION

The present invention provides a developing apparatus which supports a pair of sleeves such that one of the sleeves is swingable relative to the other sleeve, so that magnetic poles in the swingable sleeve can be adjusted even when a gap between the sleeves is maintained constant.

An image forming apparatus according to an aspect of the present invention includes a developing apparatus including a first developer bearing member configured to bear developer; a second developer bearing member configured to bear the developer; a connecting member connecting the second developer bearing member to the first developer bearing member such that the second developer bearing member is swingable with the first developer bearing member serving as a rotational center; a first magnetic member disposed in the first developer bearing member; a second magnetic member disposed in the second developer bearing member; and a second-magnetic-member positioning member capable of fixing the second magnetic member to the connecting member at different positions relative to the connecting member, the second-magnetic-member positioning member being provided on the connecting member.

Further features of the present invention will become apparent from the following description of exemplary embodiments with reference to the attached drawings.

DESCRIPTION OF THE EMBODIMENT

An embodiment of the present invention will be described with reference to the accompanying drawings.

Figure 1:
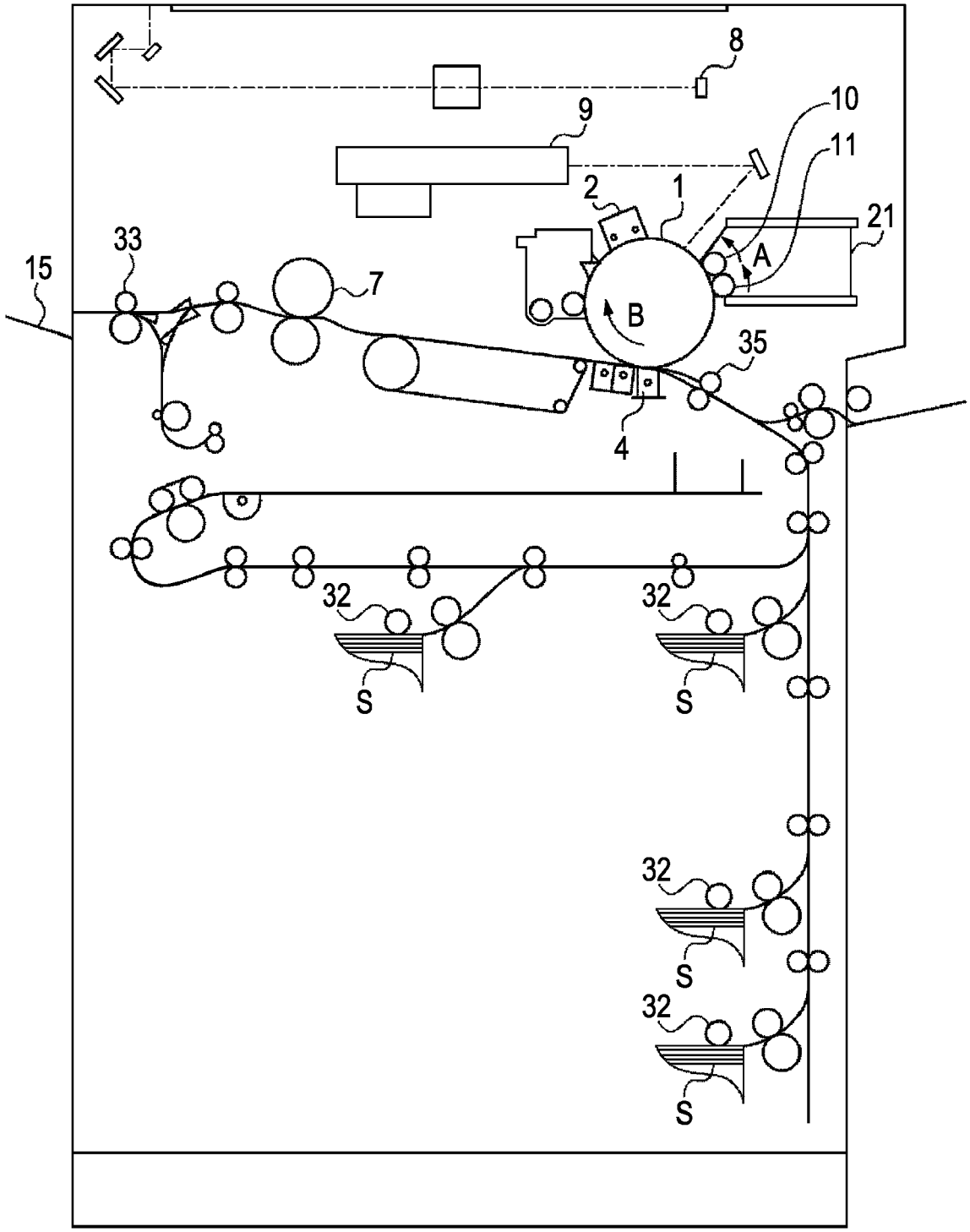
FIG. 1 is a schematic sectional view illustrating an image forming apparatus according to an embodiment of the present invention.

A developing apparatus according to an embodiment of the present invention and an image forming apparatus including the developing apparatus will be described with reference to the drawings. FIG. 1 is a schematic sectional view illustrating the image forming apparatus according to the present embodiment. The image forming apparatus forms monochrome images on recording media.

Referring to FIG. 1, an image reading unit 8 reads an image of an original document. First, image data obtained by the image reading unit 8 is stored in a controller.

In an image forming process, a surface of a photosensitive drum 1 is uniformly charged to a predetermined potential by a charging device 2 provided to charge the photosensitive drum 1. The photosensitive drum 1, which is uniformly charged, is subjected to an exposure process performed by an image writing unit 9 on the basis of the image data. As a result, an electrostatic latent image is formed on the photosensitive drum 1. The electrostatic latent image formed on the photosensitive drum 1 is developed with toner, i.e., developer, by a developing apparatus 21 so that a toner image is formed on the photosensitive drum 1. The toner image formed on the photosensitive drum 1 is transferred onto a transferring medium (recording medium) conveyed to a transferring section that faces a transferring device 4.

Recording media S, which function as transferring media, are fed one by one from one of recording-medium cassettes by pick-up rollers 32. The recording media S are conveyed to the transferring section by a pair of registration rollers 35 at a predetermined timing. When each recording medium S passes through the transferring section, the toner image formed on the photosensitive drum 1 is transferred onto the recording medium S by the transferring device 4.

The recording medium S onto which the toner image is transferred is conveyed to a pair of rollers 7 included in a fixing device. The fixing device includes a heater which generates heat. When the recording medium S is conveyed to the pair of rollers 7, the toner on the recording medium S is fixed due to pressure and heat. Then, the recording medium S is placed on a tray 15, which is disposed outside the main body of the apparatus, by ejection rollers 33 and the image forming process is finished.

The developing apparatus 21 according to the present embodiment includes a first developing sleeve 10 and a second developing sleeve 11 which are positioned so as to face the photosensitive drum 1. The first and second developing sleeves 10 and 11 are cylindrical and rotatable, and function as a first developer bearing member and a second developer bearing member, respectively.

The first and second developing sleeves 10 and 11 rotate in the same direction as shown by arrows A in FIG. 1, and convey toner to developing areas in which the photosensitive drum 1 faces the developing sleeves 10 and 11. The photosensitive drum 1 rotates in the direction shown by arrow B in FIG. 1, so that the electrostatic latent image on the photosensitive drum 1 is conveyed to the developing areas of the developing sleeves 10 and 11.

First, the electrostatic latent image formed on the photosensitive drum 1 is developed in the developing area of the first developing sleeve 10 disposed at an upstream position in the rotational direction of the photosensitive drum 1. Then, the electrostatic latent image is developed in the developing area of the second developing sleeve 11 positioned downstream of the first developing sleeve 10 in the rotational direction of the photosensitive drum 1. In the present embodiment, the potential of the electrostatic latent image is set to −200 V in an exposure area in which an image is formed and to −600 V in an image-free area. A voltage of −350 V is applied to each of the developing sleeves.

In the present embodiment, magnetic one-component toner is used as the developer. A magnetic roller is disposed as a magnetic member in each of the developing sleeves 10 and 11. The toner is contained in a developer container 3 and is supplied to the developing sleeves 10 and 11 due to magnetic fields generated by the magnetic rollers. The toner is supplied in such a manner that the toner forms a thin layer with a predetermined thickness on each of the developing sleeves 10 and 11, and is transferred to the photosensitive drum 1 in an area where the negative charge of the uniformly charged photosensitive drum 1 is reduced due to the exposure process. Thus, reversal development is performed. Normally, a developing bias in which, for example, a DC voltage is superimposed on an AC voltage is applied to each of the developing sleeves 10 and 11 in the developing process.

If the developing process is performed using a plurality of developing sleeves as described above, the development area can be increased compared to the case in which a single developing sleeve is used. Thus, the processing speed of the image forming process can be increased. More specifically, in the case where a single developing sleeve is used, the processing speed can be increased by increasing the rotational speed of the developing sleeve. In such a case, the temperature of the developing sleeve increases and there is a risk that the toner melts and adheres to the developing sleeve. Such a risk can be avoided when a plurality of developing sleeves are used. In addition, a problem that the developer quality will be degraded due to an increase in the friction of the developer and an image failure will occur can be avoided.

The detailed structure of the developing apparatus 21 will now be described with reference to FIGS. 2, 3A and 3B, and 4.

Figure 2:
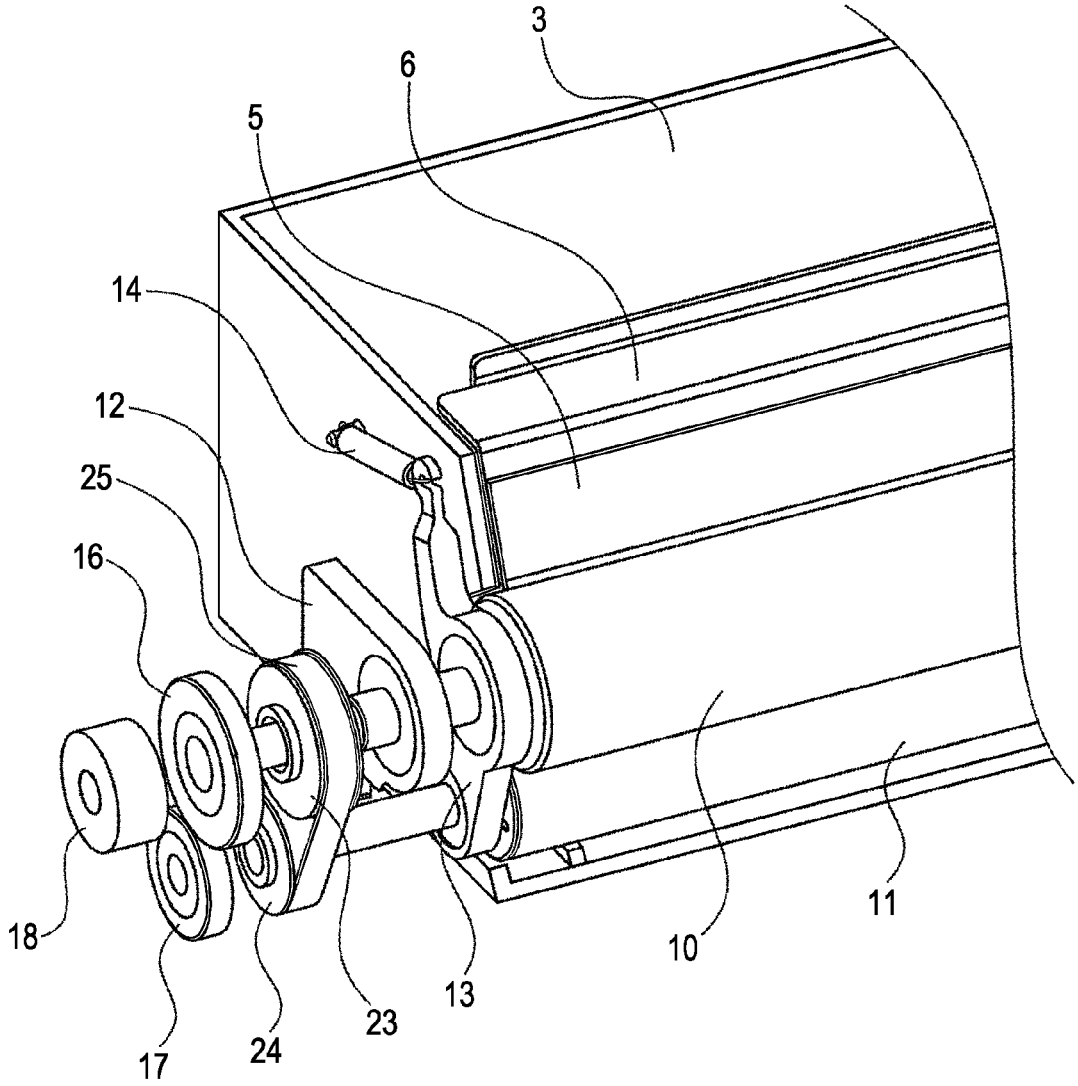
FIG. 2 is a first schematic diagram illustrating a developing device according to the embodiment of the present invention.
Figure 3B:
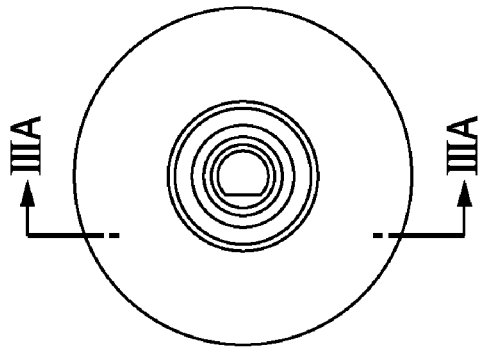
FIGS. 3A and 3B are sectional views of a developing sleeve according to the embodiment of the present invention.
Figure 3A:
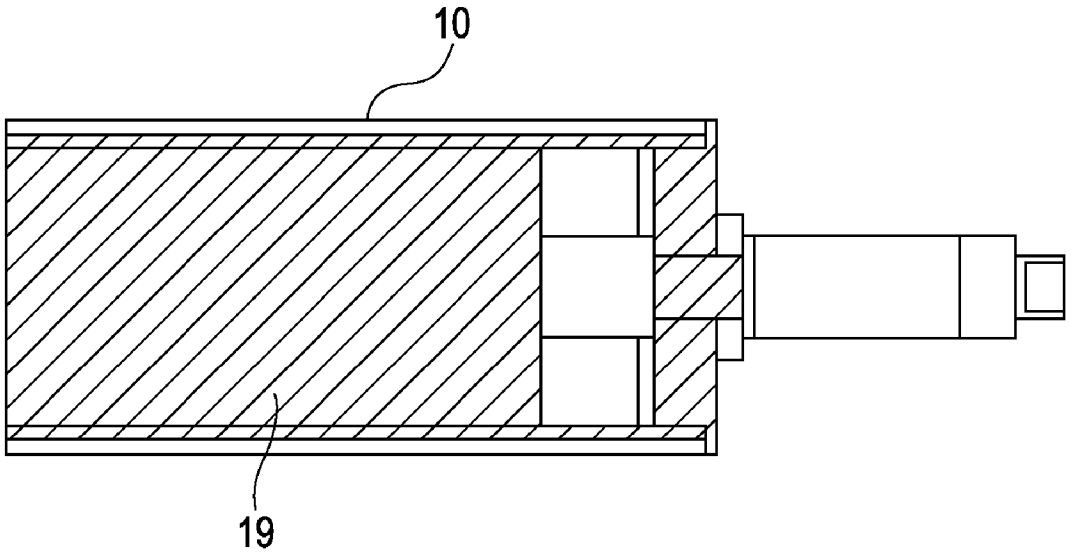

As shown in FIGS. 2, 3A, and 3B, a first magnetic roller 19, which functions as a first magnetic member, is disposed in the first developing sleeve 10. The first developing sleeve 10 is supported by a bearing holder 12 at each end thereof, and is fixed to the developer container 3 together with the bearing holder 12. Therefore, the position of the first developing sleeve 10 relative to the developing apparatus 21 is fixed. A second magnetic roller 20, which functions as a second magnetic member, is disposed in the second developing sleeve 11. The second developing sleeve 11 is supported by a swingable connecting holder 13, which functions as a connecting member, and the swingable connecting holder 13 is supported by the first developing sleeve 10 in a swingable manner. The first developing sleeve 10 and the second developing sleeve 11 are attached to the swingable connecting holder 13, so that the gap between the developing sleeves 10 and 11 is maintained constant. In other words, the distance between the rotational axes of the developing sleeves 10 and 11 can be maintained constant. The swingable connecting holder 13 is attached to the developing device with a first pressing spring 14, which functions as an elastic member. The swingable connecting holder 13 and the pressing spring 14 form a connecting unit that connects the first developing sleeve 10 and the second developing sleeve 11 to each other such that the second developing sleeve 11 can swing relative to the first developing sleeve 10. In this structure, since the first developing sleeve 10 is fixed to the developing device and does not move, the second developing sleeve 11 is swingable about the first developing sleeve 10 with respect to the developing device. The swingable connecting holder 13 is constantly urged toward the photosensitive drum 1 by the first pressing spring 14. The developer container 3 has a restraining member which restrains the second developing sleeve 11 from moving by an amount equal to or larger than a predetermined amount, and the swingable connecting holder 13 is swingable within a predetermined angle range. The second developing sleeve 11 can swing to a position closer to the photosensitive drum 1 than a predetermined position. In the present embodiment, the mechanism for holding the first developing sleeve 10 and the second developing sleeve 11 and the mechanism for allowing the second developing sleeve 11 to swing are provided at each end of the developing sleeves 10 and 11. As described above, the gap between the first developer bearing member and the second developer bearing member is maintained constant, and the position of the second developer bearing member relative to the first developer bearing member is variable.

A holding member 6 which is fixed to the developer container 3 and a developer restraining member 5 which is held by the holding member 6 are disposed above the first developing sleeve 10. The toner on the first developing sleeve 10 forms a thin layer with a uniform thickness which corresponds to the gap between the developer restraining member 5 and the first developing sleeve 10.

The gap between the first developing sleeve 10 and the photosensitive drum 1 (hereinafter called a first SD gap) and the gap between the second developing sleeve 11 and the photosensitive drum 1 (hereinafter called a second SD gap) must be controlled with high accuracy. In addition, the gap between the first developing sleeve 10 and the second developing sleeve 11 (hereinafter called an SS gap) must also be controlled with high accuracy. Therefore, a contact roller 16, which functions as a contact member, is provided coaxially with the first developing sleeve 10 so that the contact roller 16 comes into contact with the peripheral surface of the photosensitive drum 1 and a gap is reliably provided between the first developing sleeve 10 and the photosensitive drum 1. Similarly, a contact roller 17 is provided coaxially with the second developing sleeve 11 so that the contact roller 17 comes into contact with the peripheral surface of the photosensitive drum 1 and a gap is reliably provided between the second developing sleeve 11 and the photosensitive drum 1. The SS gap is reliably set in accordance with the distance between the centers of bearing holes formed in the swingable connecting holder 13. In the present embodiment, the thickness of the toner layer on the second developing sleeve 11 is determined by the SS gap.

An input gear 18 receives a rotational driving force from an input gear (not shown) disposed in the main body of the image forming apparatus, and transmits the rotational driving force to the first developing sleeve 10. A timing belt 25 is stretched between pulleys 23 and 24 provided on rotational shafts of the first developing sleeve 10 and the second developing sleeve 11, respectively. Therefore, the rotational driving force is also transmitted to the second developing sleeve 11 through the timing belt 25.

Figure 5:
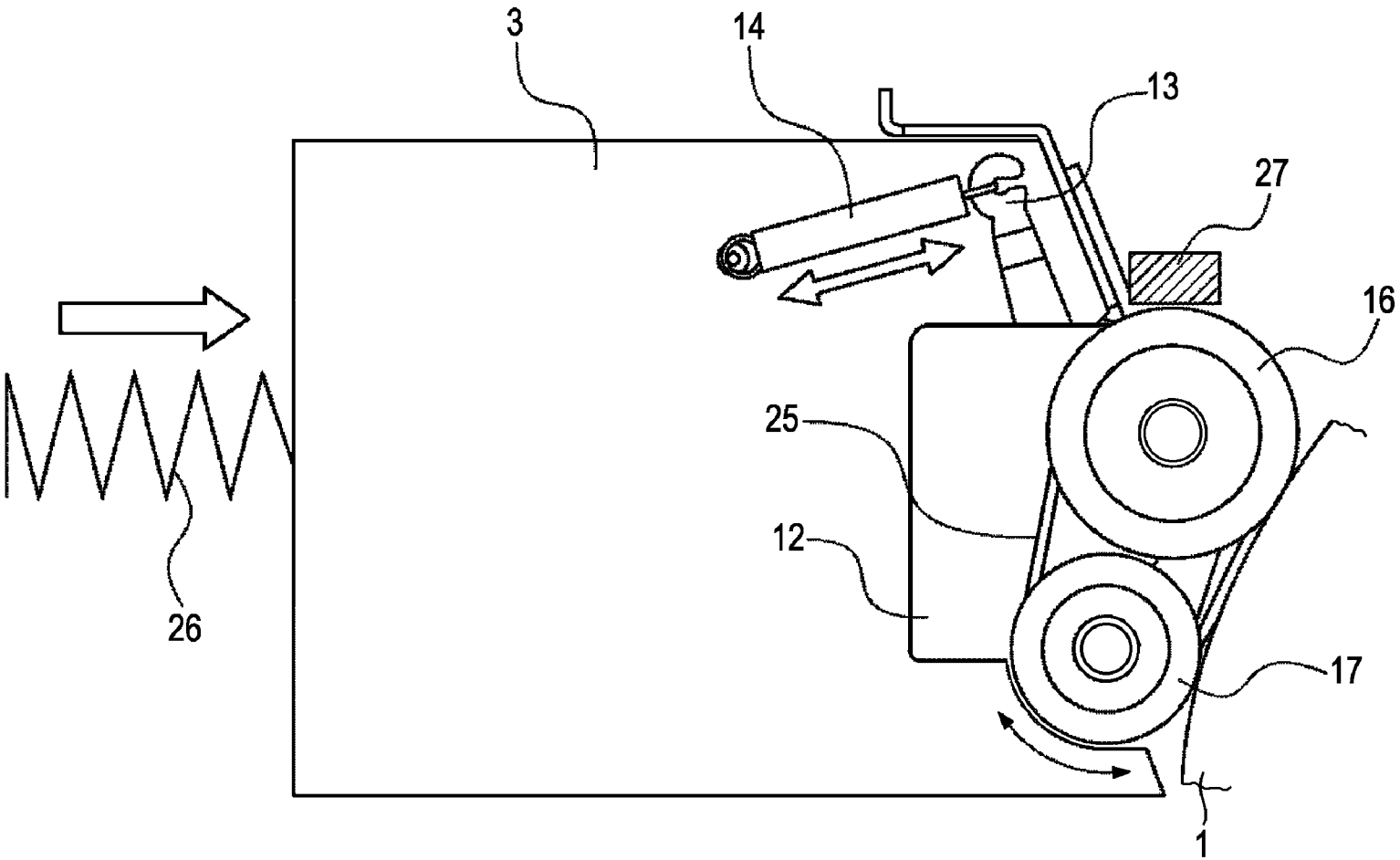
FIG. 5 is a first side view of the developing device according to the embodiment of the present invention.

The structure for positioning the developing device with respect to the photosensitive drum 1 will now be described. As shown in FIG. 5, the developer container 3 of the developing apparatus is urged toward the photosensitive drum 1 by a second pressing spring 26. First, the contact roller 17 of the second developing sleeve 11 comes into contact with the photosensitive drum 1, and is then caused to swing about the first developing sleeve 10 to a predetermined position by the swingable connecting holder 13. Then, the contact roller 16 of the first developing sleeve 10 comes into contact with the photosensitive drum 1. The developing device is positioned in the vertical direction by causing the contact roller 16 to come into contact with a positioning member 27 fixed on a frame. Thus, the first SD gap, the second SD gap, and the SS gap are determined.

The pressing force applied to the contact rollers 16 and 17 is set to about 1 kg to 2 kg for each contact roller in consideration with the deformation thereof. If the pressing force is excessively large, the SD gaps are reduced due to the deformation of the contact rollers 16 and 17. Conversely, if the pressing force is too weak, the state in which the contact rollers 16 and 17 are in contact with the photosensitive drum 1 becomes unstable and there is a risk that the contact rollers 16 and 17 will become separated from the photosensitive drum 1. Thus, variation in the pressing force applied to the contact rollers 16 and can be set as small as possible.

The reason why the contact rollers 16 and 17 can come into contact with the photosensitive drum 1 even when the pressing force applied to the second pressing spring 26 is small will now be described. The first developing sleeve 10, of which the position relative to the developing device is fixed, has the contact roller 16 at each end thereof. Three points including contact points between the photosensitive drum 1 and the contact rollers 16 at either end of the first developing sleeve 10 and a contact point between the photosensitive drum 1 and the contact roller 17 at one end of the second developing sleeve 11 define a plane. In the present embodiment, the contact roller 17 at each end of the second developing sleeve 11 is movable relative to the developing apparatus 21. Therefore, the contact roller at the other end of the second developing sleeve 11 is capable of moving relative to the developing apparatus 21 such that the contact point thereof will be placed on the above-described plane. Thus, the remaining contact roller of the second developing sleeve 11 moves relative to the developing apparatus 21 such that the contact point between the contact roller 17 and the photosensitive drum 1 will be placed on the above-described plane. As a result, all of the contact rollers 16 and 17 of the developing sleeves 10 and 11 can come into contact with the photosensitive drum 1 even if the pressing force by which the developing device is pressed against the photosensitive drum 1 is small.

In addition, according to the present embodiment, since the swingable connecting holder 13 is provided, even when the positions of the ends of the second developing sleeve 11 relative to the developing device are changed, the distance between the developing sleeves 10 and 11 can be maintained constant.

Thus, according to the structure of the present embodiment, even when the pressing force by which the developing apparatus is urged toward the image bearing member is reduced, the gaps between the image bearing member and the developer bearing members can be ensured with high accuracy while maintaining the gap between the developer bearing members.

In the present embodiment, the contact members are brought into contact with the image bearing member so as to maintain the gaps between the image bearing member and the developer bearing members. However, according to the present invention, the member with which the contact members are brought into contact is not limited to the image bearing member, and the contact members may also be brought into contact with a portion of the frame which supports the image bearing member. The member with which the contact members are brought into contact can be a member which determines the position of the image bearing member relative to the frame. In such a case, the gaps between the image bearing member and the developer bearing members can be accuracy maintained.

Next, a characteristic structure of the present invention in which the positions at which magnetic members are attached to the developer bearing members in the rotational direction thereof will be described.

FIGS. 3A and 3B are sectional views of the first developing sleeve 10. The first magnetic roller 19 is disposed in the first developing sleeve 10. The first magnetic roller 19 has a cylindrical shape, and a shaft is fixed at the center of the first magnetic roller 19. An end portion of the shaft is formed in a D shape, and the D-shaped portion extends out through a pipe-shaped flange of the first developing sleeve 10. Therefore, the pole arrangement in the first magnetic roller 19 can be easily checked visually from the position of the D-shaped portion. The structure of the second developing sleeve 11 is similar to that of the first developing sleeve 10.

Figure 7:
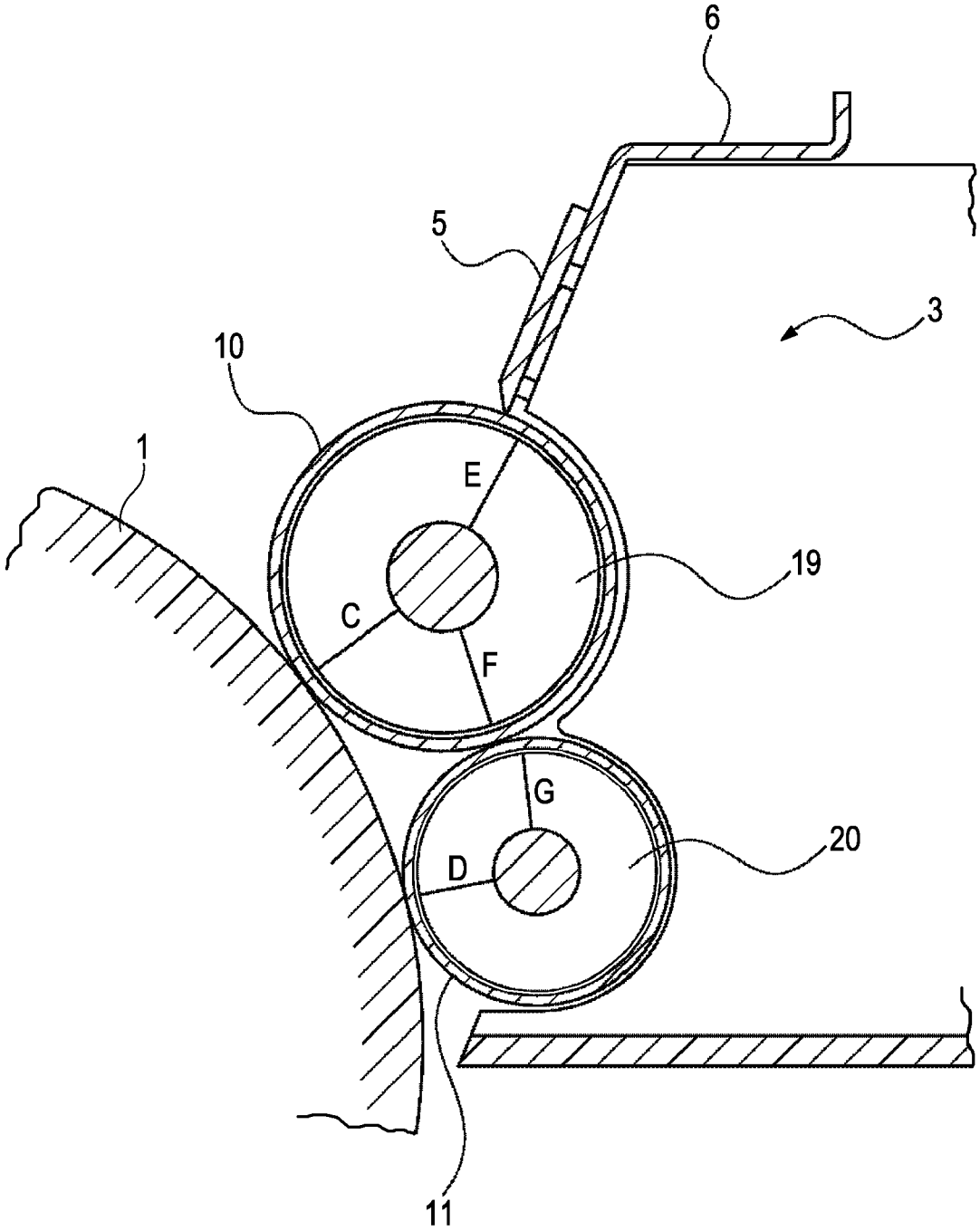
FIG. 7 is a sectional view of the developing device according to the embodiment of the present invention.

FIG. 7 shows the structure of magnetic rollers disposed in the first developing sleeve 10 and the second developing sleeve 11. A cutting pole E (N pole) is a magnetic pole for regulating the toner on the first developing sleeve 10. A developing pole C (S pole) is a magnetic pole for developing the electrostatic latent image on the photosensitive drum 1 with the toner on the first developing sleeve 10. A magnetic pole F (N pole) generates magnetic power that attracts toner around an SS portion to the first developing sleeve 10. A magnetic pole D (S pole) is used for developing the electrostatic latent image on the photosensitive drum 1 with the toner on the second developing sleeve 11. A magnetic pole G (N pole) generates magnetic power that attracts toner around the SS portion to second developing sleeve 11.

Figure 4:
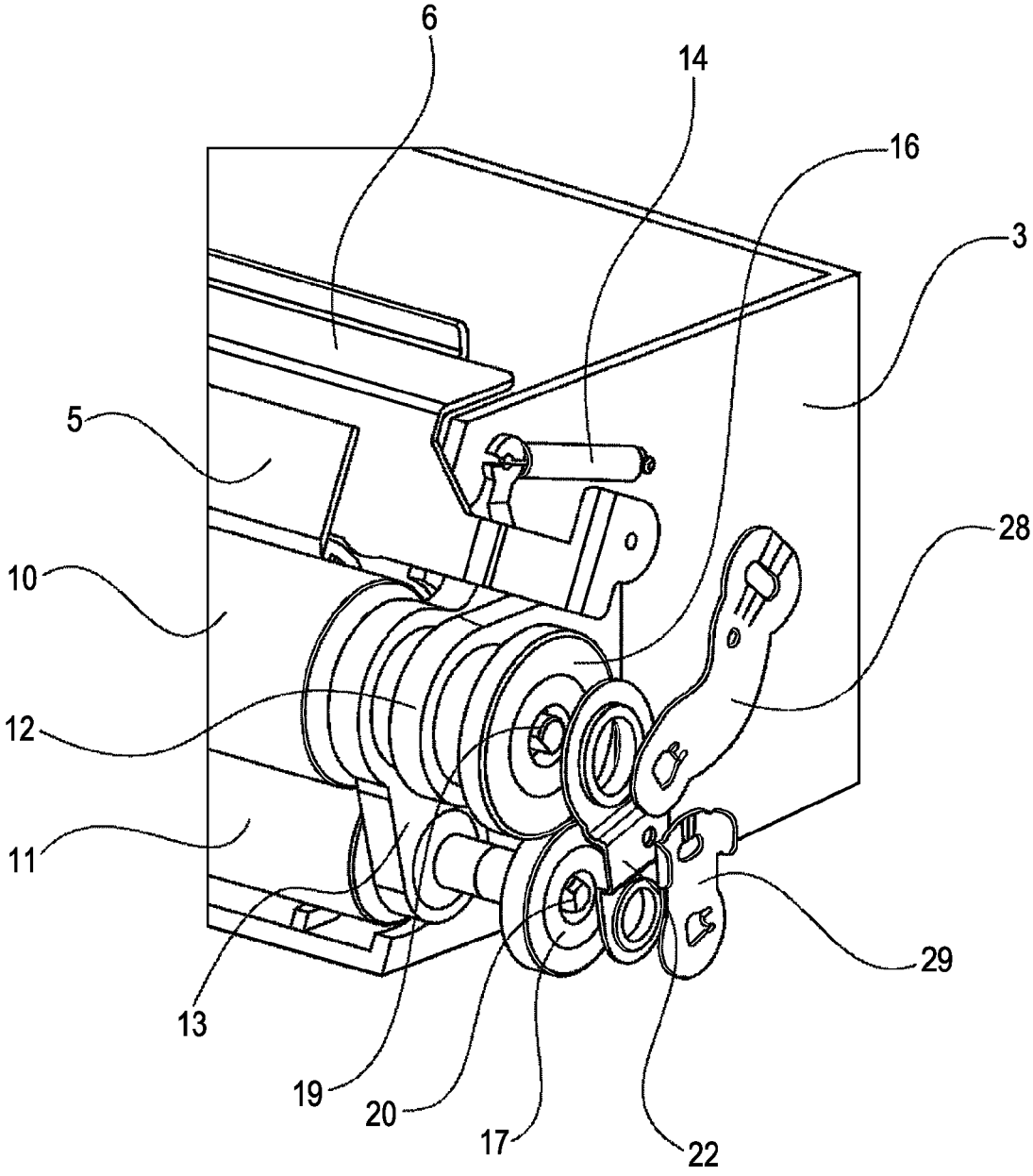
FIG. 4 is a second schematic diagram illustrating the developing device according to the embodiment of the present invention.

FIG. 4 shows the structure of the developing sleeves 10 and 11 at an end opposite to the end having the driving unit. The bearing holder 12, the swingable connecting holder 13, and the contact rollers 16 and 17 provided at this end have the same structures as those at the opposite end. The shafts of the first magnetic roller 19 and the second magnetic roller 20 project from the ends of the first developing sleeve 10 and the second developing sleeve 11. The shafts are formed in a D shape at the ends thereof. A swingable connecting member 22, which functions as a conductive connecting member, is disposed outside the contact rollers 16 and 17. To ensure the conductivity of the swingable connecting member 22, the swingable connecting member 22 is formed of a metal plate (for example, EGC-QS-20/20), which is electrically conductive. Since an engagement portion between the first developing sleeve 10 and the second developing sleeve 11 undergoes friction, the engagement portion is formed by press-fitting a copper-based sintered body into the metal plate. A first magnetic-pole position fixing member 28, which functions as a first adjusting member, and a second magnetic-pole position fixing member 29, which functions as a second adjusting member, are provided outside the above-mentioned components. The first magnetic-pole position fixing member 28 and the second magnetic-pole position fixing member 29 are used to fix the first magnetic roller 19 and the second magnetic roller 20, respectively. The first magnetic-pole position fixing member 28 and the second magnetic-pole position fixing member 29 respectively function also as a first positioning member and a second positioning member for positioning the magnetic poles of the first magnetic roller 19 and the second magnetic roller 20, respectively, in the circumferential direction of the first developing sleeve 10 and the second developing sleeve 11.

Figure 12A:
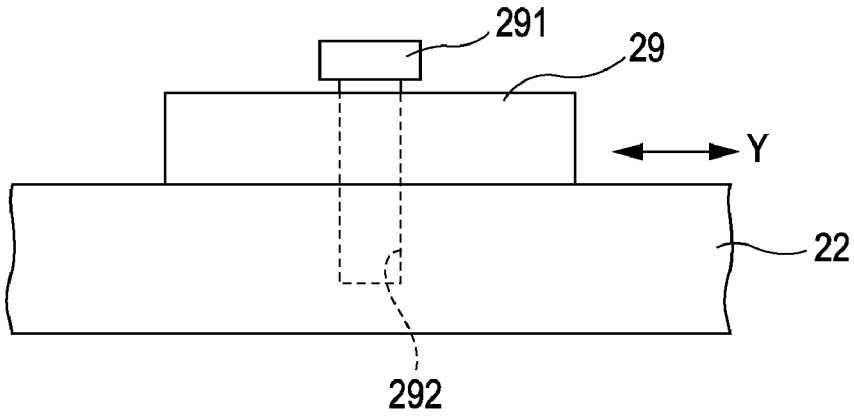
FIGS. 12A and 12B are schematic diagrams illustrating a magnetic-pole adjusting mechanism in a developing sleeve according to the embodiment of the present invention.
Figure 12B:
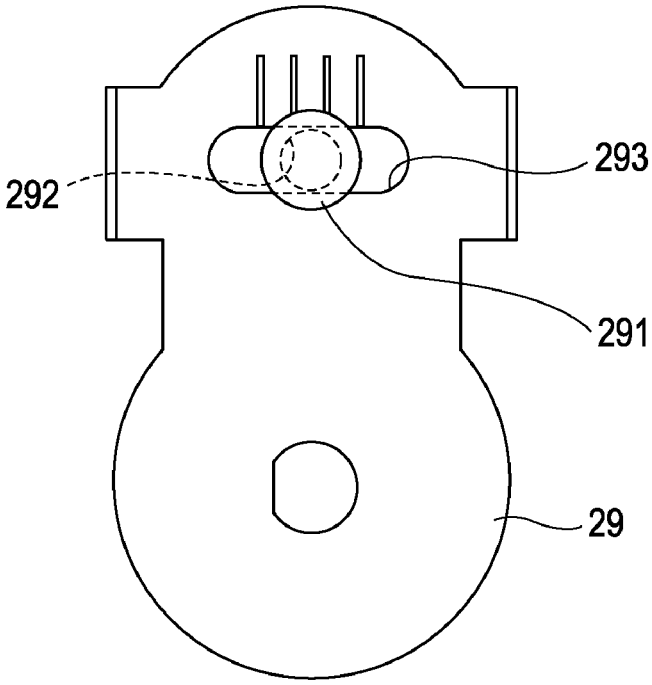

The first magnetic-pole position fixing member 28 and the second magnetic-pole position fixing member 29 are formed of beryllium copper, which is electrically conductive. The magnetic-pole position fixing members 28 and 29 have D-shaped holes, long holes, and mark-off lines formed with constant intervals. The D-shaped portions of the magnetic rollers 19 and 20 are inserted into the D-shaped holes. The first magnetic-pole position fixing member 28 is fixed to the holding member 6 by fastening a screw to a screw hole formed in the holding member 6, so that the positional relationship between the first magnetic-pole position fixing member 28 and the developer restraining member 5 is fixed. The second magnetic-pole position fixing member 29 is fixed to the swingable connecting member 22 by fastening a screw 291 to a screw hole 292 formed in the swingable connecting member 22, so that the second magnetic-pole position fixing member 29 does not block the movement of the second developing sleeve 11. The adjustment of the magnetic poles will be described in detail below using the second magnetic roller 20 as an example. FIG. 12A is a cross sectional view of the structure in which the second magnetic-pole position fixing member 29 is fastened to the swingable connecting member 22. FIG. 12B is a top view of the second magnetic-pole position fixing member 29 viewed in the axial direction of the developing sleeves 10 and 11. The second magnetic roller 20 can be rotated along the circumferential direction of the second developing sleeve 11 by moving the second magnetic-pole position fixing member 29 in the Y direction in FIG. 6. Thus, the positions of the magnetic poles can be adjusted. After the position of the second magnetic-pole position fixing member 29 is adjusted, the screw 291 is inserted through a long hole 293 formed in the second magnetic-pole position fixing member 29 and is fastened to the screw hole 292 formed in the swingable connecting member 22. Thus, the second magnetic-pole position fixing member 29 is fixed to the swingable connecting member 22. Similarly, the positions of the magnetic poles of the first magnetic roller 19 are adjusted by moving the first magnetic-pole position fixing member 28 in the X direction in FIG. 6. Then, the first magnetic-pole position fixing member 28 is fixed to the developer container 3 with a screw.

As described above, it is necessary that the first developing sleeve 10 and the second developing sleeve 11 receive the developing bias at the same potential. The developing bias is reliably input from a power supply (not shown) in the main body to the developing sleeves 10 and 11 through the swingable connecting member 22 as follows. That is, the developing bias is successively supplied through the first magnetic-pole position fixing member 28, the first magnetic roller 19, the first developing sleeve 10, the swingable connecting member 22, the second developing sleeve 11, the second magnetic-pole position fixing member 29, and the second magnetic roller 20.

Figure 6:
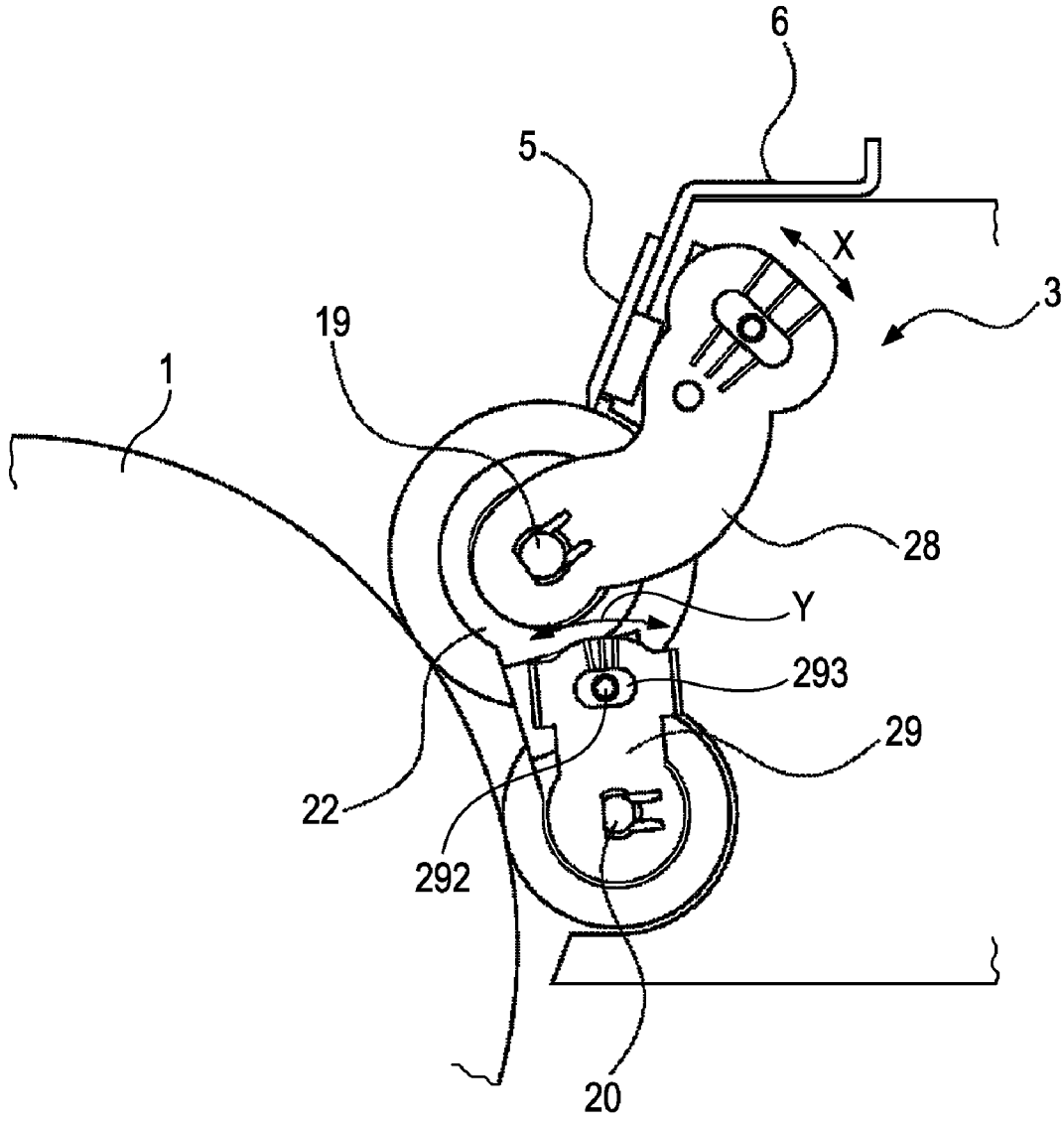
FIG. 6 is a second side view of the developing device according to the embodiment of the present invention.

Referring to FIG. 6, the positions of the magnetic poles in the first magnetic roller 19 and the second magnetic roller 20 are adjusted with reference to the mark-off lines formed on the first magnetic-pole position fixing member 28 and the second magnetic-pole position fixing member 29 when viewed from the front. The adjustment range of each of the magnetic-pole position fixing members 28 and 29 is set to ±5° in consideration of the tolerance of the magnetic rollers 19 and 20 themselves, which is ±3°, the tolerance of the D-shaped portions, and the tolerance of the attachment position of the developer restraining member 5.

The magnetic-pole position fixing members 28 and 29 are rotated so as to adjust the positions of the developing poles C and D, the cutting pole E, and the SS magnetic poles F and G in the first and second magnetic rollers 19 and 20 shown in FIG. 7. The adjustments of the cutting pole E and the SS magnetic pole are considered high priorities. The adjustment of the first magnetic roller 19 can be performed by adjusting the cutting pole E, and the adjustment of the second magnetic roller 20 can be performed by adjusting the SS magnetic pole.

The arrangement of the magnetic-pole position fixing members 28 and 29 according to the present embodiment will be described below. The magnetic-pole position fixing member 28 adjusts the positions of the magnetic poles in the first magnetic roller 19 disposed in the first developing sleeve 10, which is fixed to the developing device. The position of the first developing sleeve 10 relative to the developing device is fixed. Therefore, a portion of the first magnetic-pole position fixing member 28 can be fixed to the developing device. In comparison, the magnetic-pole position fixing member 29 adjusts the positions of the magnetic poles in the second magnetic roller 20 disposed in the second developing sleeve 11, which is movable relative to the developing device. The second magnetic roller 20 moves together with the second developing sleeve 11. Therefore, if the magnetic-pole position fixing member 29 is attached to the developing device, the magnetic-pole position fixing member 29 cannot be reliably fixed and the magnetic poles cannot be stably positioned. Therefore, according to the present embodiment, the magnetic-pole position fixing member 29 is fixed to the swingable connecting member 22 so that the position of the second magnetic roller 20 can be stabilized after the adjustment thereof even if the position of the second magnetic roller 20 relative to the developing device changes.

Figure 8:
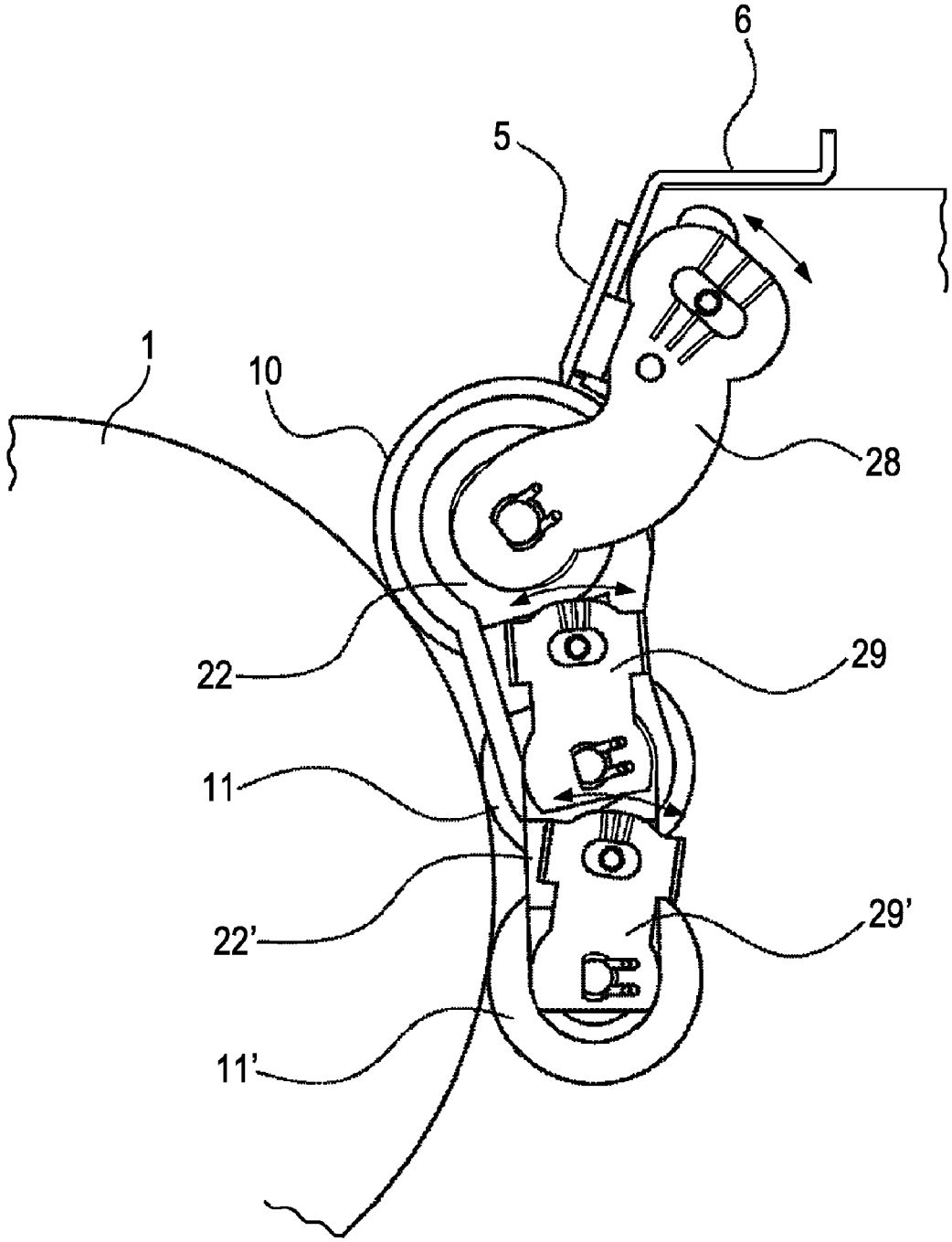
FIG. 8 is a third side view of the developing device according to the embodiment of the present invention.

In addition, in the case where the number of developing sleeves (10, 11, 11') is three, as shown in FIG. 8, or more, swingable connecting members (22, 22') can be disposed between the adjacent developing sleeves, and each swingable connecting member can have a magnetic-pole position fixing member (29, 29') provided thereon. In such a case, the magnetic pole adjustment can be performed individually using the magnetic-pole position fixing members. Also in such a case, adjustment members for adjusting the movable magnetic rollers are attached to the respective swingable connecting members.

Figure 9:
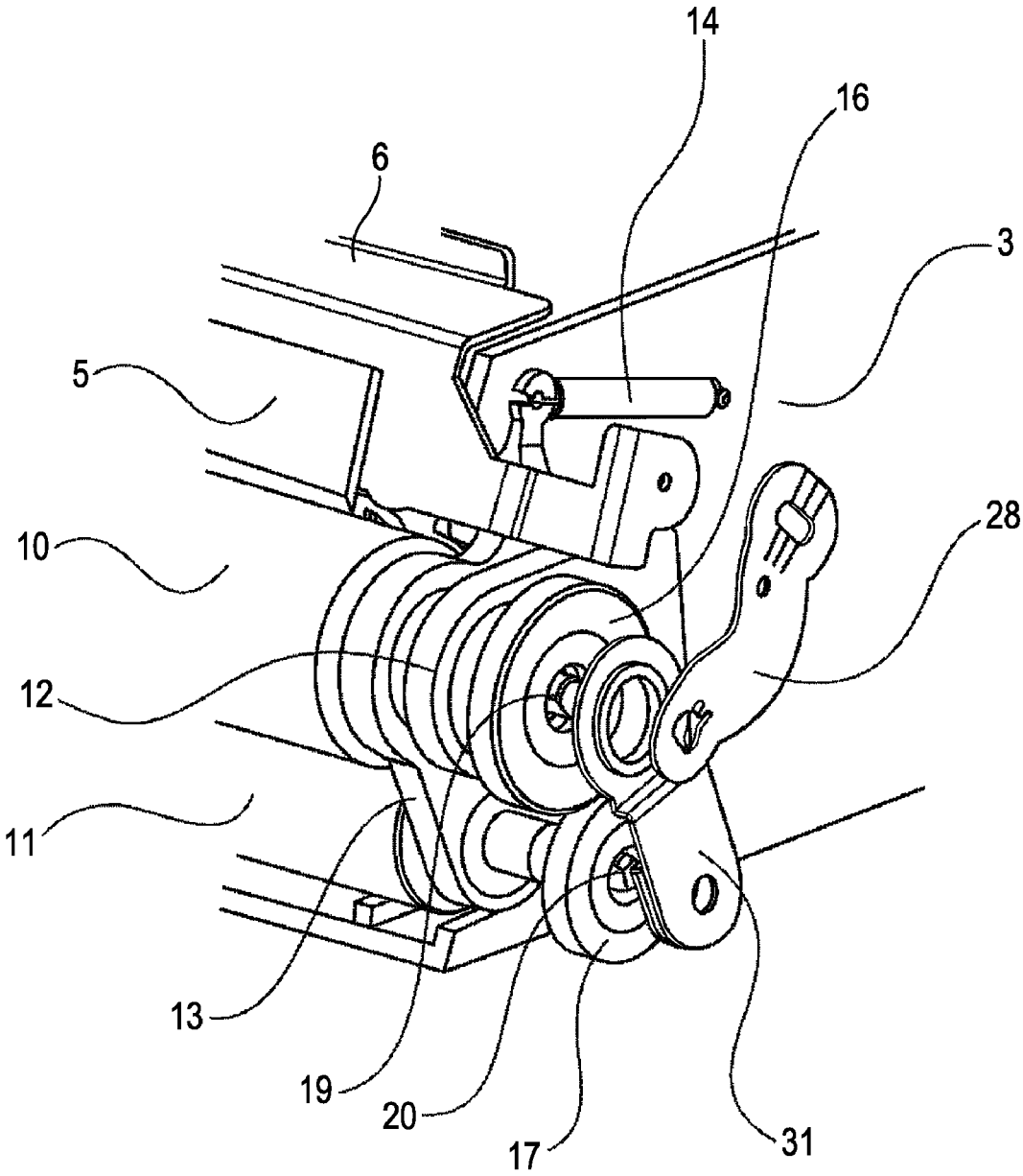
FIG. 9 is a third schematic diagram illustrating the developing device according to the embodiment of the present invention.
Figure 10A:
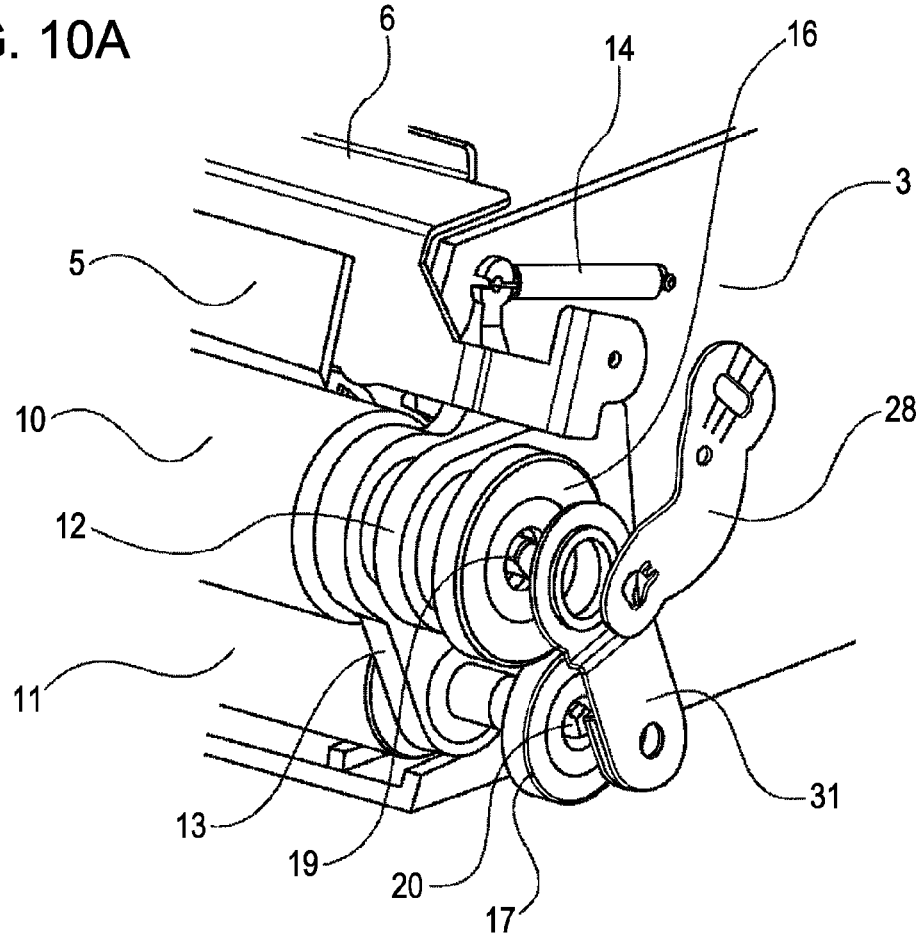
FIGS. 10A and 10B show a fourth schematic diagram illustrating the developing device according to the embodiment of the present invention.
Figure 10B:
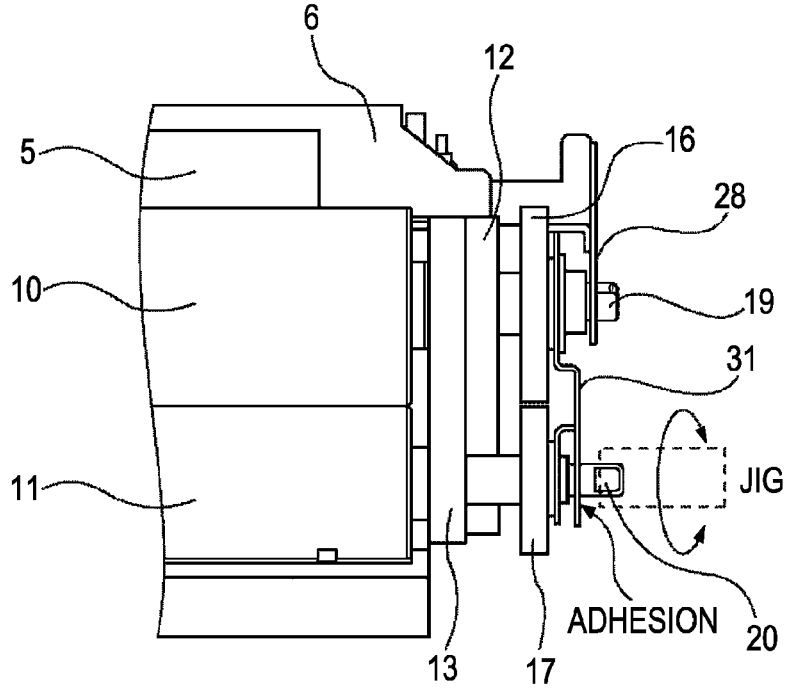
Figure 11:
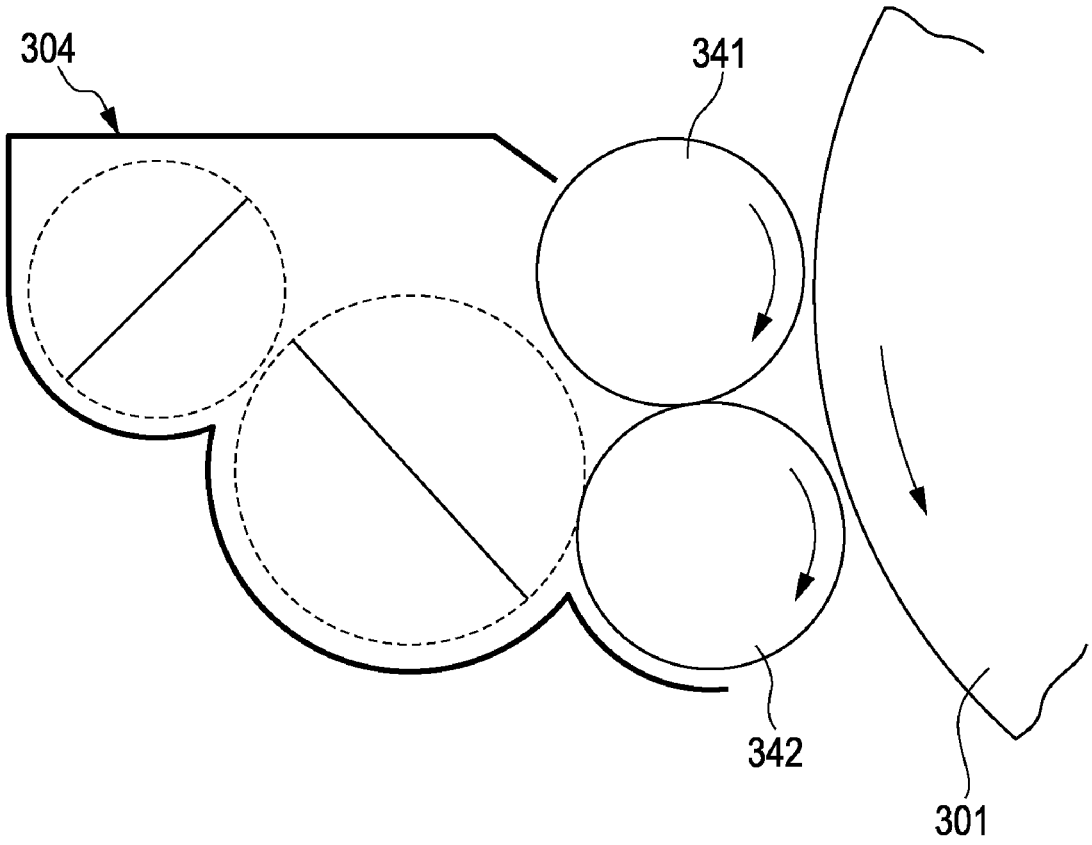
FIG. 11 PRIOR ART
FIG. 11 is a diagram illustrating a developing device having a plurality of developing sleeves according to a related art.

According to another example of a method for adjusting the magnetic poles, as shown in FIGS. 9, 10A, and 10B, a connecting-and-fixing member 31 structured such that the swingable connecting member 22 and the magnetic-pole position fixing member 29 are integrated with each other is used.

FIG. 9 is the structure in which the magnetic pole adjustment can be performed with a single component by attaching the connecting-and-fixing member 31 having the D hole at a predetermined angle in a replaceable manner.

In FIG. 10A, the D hole in the connecting-and-fixing member 31 is formed as a circular hole. After the position of the shaft of the second magnetic roller 20 is adjusted with a jig, the connecting-and-fixing member 31 and the shaft of the second magnetic roller 20 are fixed to each other by adhesion, welding, or the like. FIG. 10B shows the longitudinal structure of the developing apparatus 21 viewed from the direction of the photosensitive drum 1. The D-shaped portion of the shaft of the second magnetic roller 20 protrudes from the connecting-and-fixing member 31. Then, the D-shaped portion is secured to the jig and the magnetic pole adjustment is performed by rotating the D-shaped portion. When the D-shaped portion reaches the desired position, the shaft of the second magnetic roller 20 and the connecting-and-fixing member 31 are adhered or welded to each other. In this structure, the magnetic pole adjustment can be performed without replacing the connecting-and-fixing member 31.

In the present embodiment, coil springs are used as elastic members for pressing the developer container 3 against the photosensitive drum 1 and for pressing the second developing sleeve 11 against the photosensitive drum 1. However, the present invention is not limited to this, and other various elastic members, such as leaf springs, torsion coil springs, etc., can also be used.

In addition, according to the present embodiment, bearings (ball bearings) are used as supporting members for supporting the first and second developing sleeves 10 and 11. However, the present invention is not limited to this, and slide bearings made of a material including resin and sintered metal may also be used.

In addition, although it is described above that the second magnetic-pole position fixing member 29 is fixed to the swingable connecting member 22, the second magnetic-pole position fixing member 29 may also be fixed to the swingable connecting holder 13 as long as conductivity can be provided by the swingable connecting holder 13.

In addition, in the present embodiment, the contact rollers are pressed against the photosensitive drum. However, the present invention is not limited to this, and the contact rollers may also be pressed against a contact member provided on the frame.

In addition, although it is described above that the driving force is transmitted through the timing belt, a chain or the like may also be used.

The developing method is not limited to that described in the present embodiment, and other known developing methods may also be used for processing each developing area (each developer bearing members). For example, two-component developer including magnetic carrier and non-magnetic toner can be used as the developer. The developer bearing members having magnetic-field generators bear the two-component developer such that they are napped, that is, such that magnetic brushes are formed. The thus-obtained magnetic brushes are brought into contact with the image bearing member, or is positioned so as to face the image bearing member in a non-contact state so that the electrostatic latent image formed on the image bearing member is developed.

In the above-described embodiment, the monochrome image forming apparatus is explained. However, similar effects can, of course, also be obtained when the present invention is applied to the developing device used in color image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-292190 filed Nov. 9, 2007, which is hereby incorporated by reference herein in its entirety.

What is claimed is:

1. A developing apparatus, comprising:

a first developer bearing member configured to bear developer;

a second developer bearing member configured to bear the developer;

a connecting member connecting the second developer bearing member to the first developer bearing member such that the second developer bearing member is swingable with the first developer bearing member serving as a rotational center;

a first magnetic member disposed in the first developer bearing member;

a second magnetic member disposed in the second developer bearing member; and a second-magnetic-member positioning member capable of fixing the second magnetic member to the connecting member at different positions relative to the connecting member, the second-magnetic-member positioning member being provided on the connecting member.

2. The developing apparatus according to claim 1, wherein the second developer bearing member is capable of swinging about the first developer bearing member.

3. The developing apparatus according to claim 1, wherein the second-magnetic-member positioning member positions the second magnetic member in a rotational direction of the second developer bearing member.

4. The developing apparatus according to claim 1, further comprising a first-magnetic-member positioning member capable of fixing the first magnetic member to a frame at different rotational positions relative to the frame, the first-magnetic-member positioning member being provided on the frame of the developing apparatus.

5. The developing apparatus according to claim 1, wherein the connecting member is a conductive member, and a developing bias is input to the first developer bearing member and the second developer bearing member through the connecting member.

* * * * *